United States Patent [19]

Picard

[11] Patent Number: 4,494,586

[45] Date of Patent: Jan. 22, 1985

[54] SAFETY DEVICE FOR A LOCKING AND OPENING SYSTEM

[75] Inventor: Claude Picard, Nanterre, France

[73] Assignee: La Calhene, Bezons, France

[21] Appl. No.: 328,537

[22] Filed: Dec. 8, 1981

[30] Foreign Application Priority Data

Dec. 16, 1980 [FR] France ..... 80 26669

[51] Int. Cl.[3] ..... E05C 7/06

[52] U.S. Cl. ..... 141/384; 49/114; 49/279; 220/200

[58] Field of Search ..... 141/311 R, 346–347, 141/348, 383, 384, 385, 386; 285/84, 91; 49/109, 114, 279, 300; 220/200

[56] References Cited

U.S. PATENT DOCUMENTS

| | | | |
|---|---|---|---|
| 3,125,232 | 3/1964 | Brinkman et al. | 414/217 |
| 3,665,958 | 5/1972 | Dunkelus | 137/522 |
| 3,682,208 | 8/1972 | Fedi et al. | 141/384 |

FOREIGN PATENT DOCUMENTS

| | | |
|---|---|---|
| 2040616 | 1/1971 | France . |
| 2137106 | 12/1972 | France . |
| 2441243 | 6/1980 | France . |
| 2441244 | 6/1980 | France . |
| 871851 | 7/1961 | United Kingdom . |

*Primary Examiner*—Houston S. Bell, Jr.

*Attorney, Agent, or Firm*—Kerkam, Stowell, Kondracki & Clarke

[57] ABSTRACT

The invention relates to a safety device for an interlocking mechanism between two sealed enclosures such as found in biological or nuclear environments and which prevents accidental opening of one or the other of two doors closing off the enclosures, which prevents leakage from the enclosures and which may be readily retrofitted to an existing locking system. The locking system comprises a locking ring (36) rotatable between an inoperative position and a locking position for locking the two enclosures and an operating lever for locking the two doors. The safety device includes two locking mechanisms electrically controlled by four prepositioned detection means on the form of microswitches for locking and unlocking the two locking mechanisms.

4 Claims, 7 Drawing Figures

SAFETY DEVICE FOR A LOCKING AND OPENING SYSTEM

BACKGROUND OF THE INVENTION

The present invention relates to a safety device for a locking and opening system making it possible to tightly connect two enclosures, each of which is equipped with a flange and a door defining an opening of the same diameter and making it possible to form a connection between these two enclosures by simultaneously opening the juxtaposed, interlocked doors.

Such a locking and opening system is more particularly used when one of the enclosures forms a cell for handling dangerous products, such as radioactive or biologically toxic products, whilst the other is a tight container enabling these products to be transferred.

More specifically the present invention relates to a safety device for a locking and opening system comprising a locking ring associated with the flange of a first enclosure and which rotates between an inoperative position in the absence of a second enclosure and a position for locking the second enclosure on the first enclosure, and an operating lever associated with the flange of the first enclosure and moving between a locking position and an unlocking position with respect to the door of the first enclosure.

The safety device according to the invention prevents personnel using the locking and opening system from committing the following manipulating and handling errors:

- opening the door of the first enclosure without the second enclosure being in place,
- disconnection of the two enclosures with the connecting doors open,
- opening the doors of the two enclosures without the locking of the second enclosure to the first enclosure being complete.

Safety devices for locking systems of a comparable type have already been studied. However, these known devices are generally entirely mechanical and are relatively complex, which significantly increases the price of the locking system. Moreover, these known devices virtually never offer a total security and can be easily rendered inoperative by a concerted act of malevolence. Finally, due to their entirely mechanical construction, the known safety devices cannot be fitted to an existing locking system without the latter undergoing signficant modifications.

BRIEF SUMMARY OF THE INVENTION

The object of the present invention is to provide a safety device making it possible to obviate the disadvantages of the known devices. More specifically the invention relates to a safety device having a particularly simple design and which can be installed without difficulty on an existing locking system, whilst elimanating any danger of accidentally or deliberately performing incorrect manipulations on this system.

To this end the invention relates to a safety device, wherein it comprises a first locking mechanism normally locking the locking ring in the inoperative position and locking position and a second locking mechanism normally locking the operating lever in the locking position, first detection means sensitive to the presence of the second enclosure for unlocking the first locking mechanism, second detection means sensitive to the presence of the locking ring in the locking position for unlocking the second locking mechanism, third detection means sensitive to the presence of the operating lever in the locking position and fourth detection means sensitive to the presence of the door of the first enclosure for unlocking the first locking mechanism.

According to a first embodiment of the invention, the detection means are constituted by microswitches. Preferably the locking mechanisms are electrically controlled and are normally closed when there is no power supply. Thus, any manipulation of the locking system becomes impossible, particularly in the case of a power failure. Thus, there is no risk of the safety system being rendered inoperative under such conditions.

BRIEF DESCRIPTION OF THE DRAWINGS

The invention is described in greater detail hereinafter relative to non-limitative embodiments and the attached drawings, wherein show:

FIG. 6 diagrammatically an embodiment of the electrical circuit controlling the locking mechanisms of the safety device according to the invention.

DETAILED DESCRIPTION OF THE PREFERRED EMBODIMENTS

The locking system and safety device shown. in FIGS. 1 to 7 make it possible to sealingly connect a container 10 to a tight enclosure 12 and interconnect the same, whilst preventing any incorrect manipulations or operations leading to any break of the seal of either of the two enclosures or of the assembly constituted by the two enclosures when they are interconnected.

Figure 1:
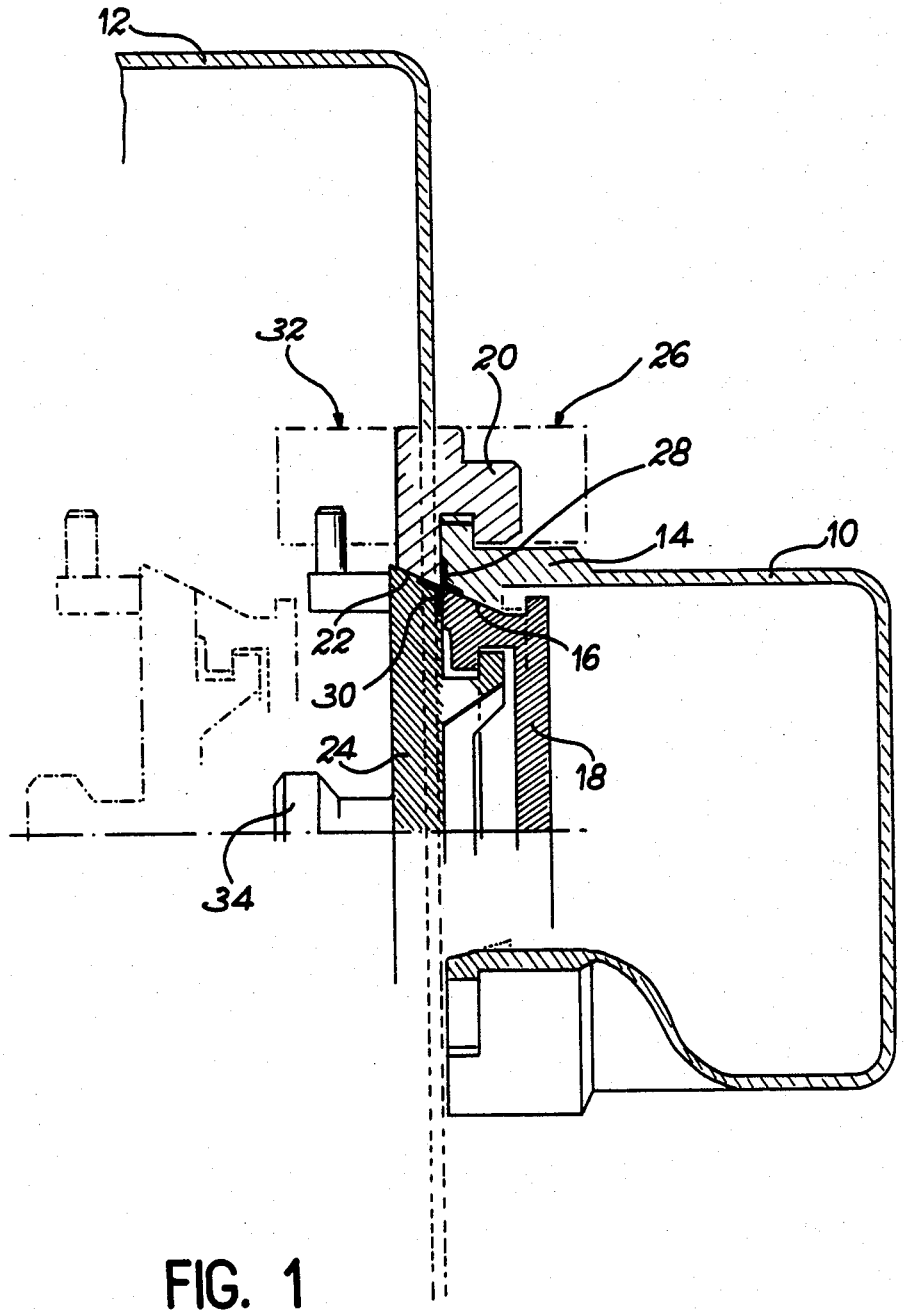
FIG. 1 a diagrammatic cross-sectional view showing the connection of a transfer container to a tight enclosure and the opening of the double door enabling connection to take place between the container and the enclosure.

As is more particularly shown in FIG. 1, container 10 is provided with an annular flange 14 defining a circular opening 16, which is normally sealed by a door 18. In the same way enclosure 12 is provided with an annular flange 20 defining a circular opening 22 normally sealed by a door 24. Container 10 is locked to enclosure 12 by means of a suitable system 26, which is not shown in FIG. 1 but which will be described in greater detail hereinafter. Openings 16 and 20 are frustum-shaped and their generatrixes coincide when container 10 is locked to enclosure 12 by means of system 26, in such a way that the double door formed by doors 18 and 24 can be removed from the interior of enclosure 12 in the manner to be shown hereinafter.

In per se known manner the seal between doors 18 and 24 and the corresponding flanges 14 and 20, as well as the seal between the doors on the one hand and the flanges on the other when container 10 is locked to enclosure 12 are obtained by means of two joints 28 and 30 respectively arranged in flange 14 and door 24 in the manner described and claimed in French Pat. No. 1 346 486 in the name of the Commissariat á l'Energie Atomique. A system 32, not shown in FIG. 1 and which will be described in greater detail hereinafter, makes it possible to unlock the double door formed by doors 18 and 24 and to remove it by means of a handle 34 formed on door 24 within enclosure 12, in the manner shown in dot-dash lines in FIG. 1.

Figure 2:
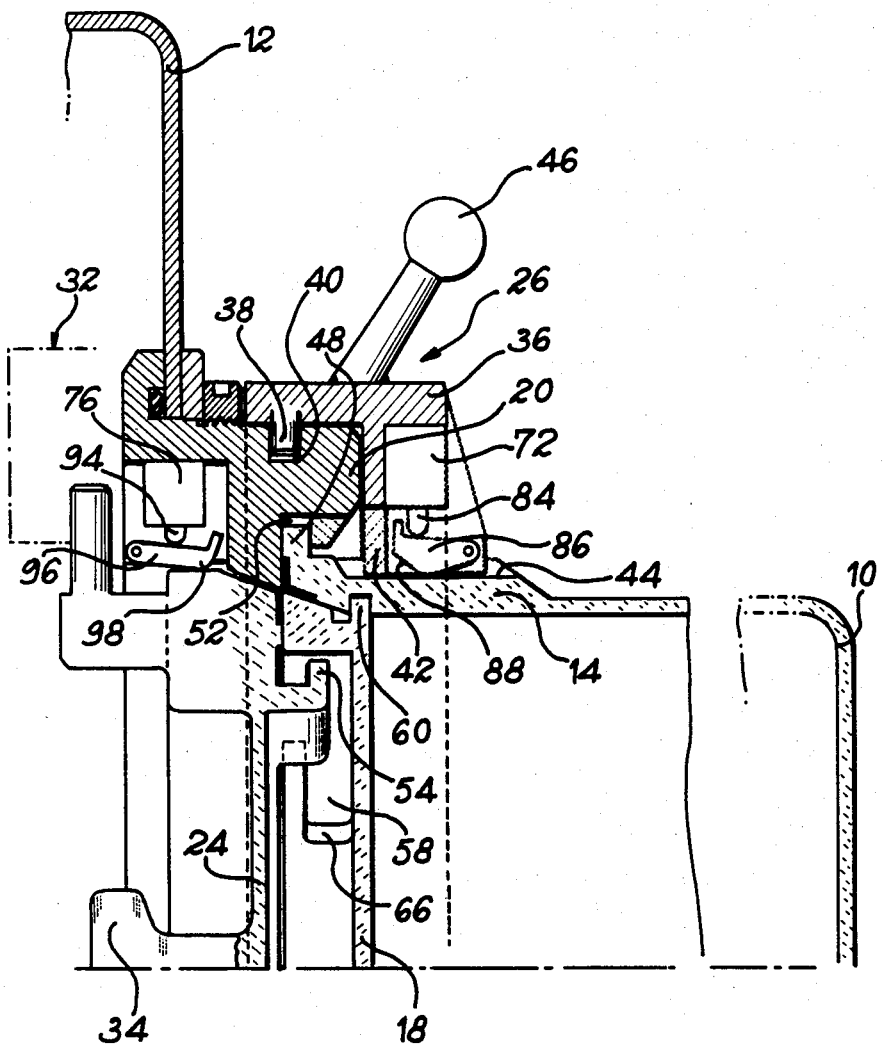
FIG. 2 a sectional view comparable to FIG. 1 showing on a larger scale the system making it possible to lock the container to the tight enclosure and the microswitches of the safety device making it possible to detect the presence of the container in the presence of the enclosure door.
Figure 3:
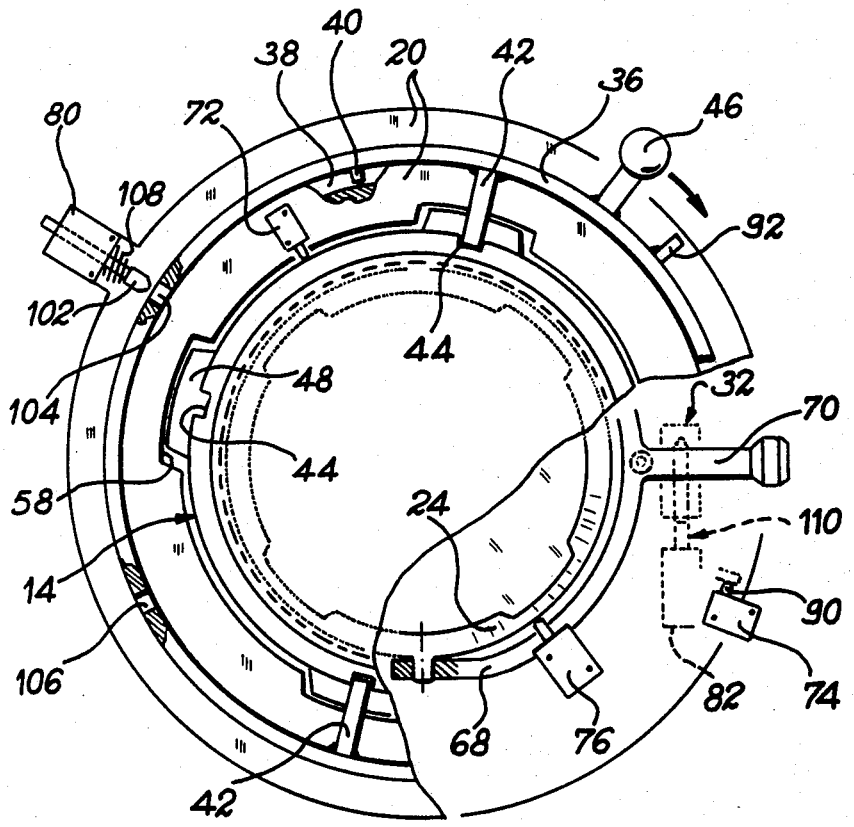
FIG. 3 an end view of the container and the locking system taken from outside the container, the drawing being partly broken away to show the rocking lever controlling the operation of the double door.
Figure 4:
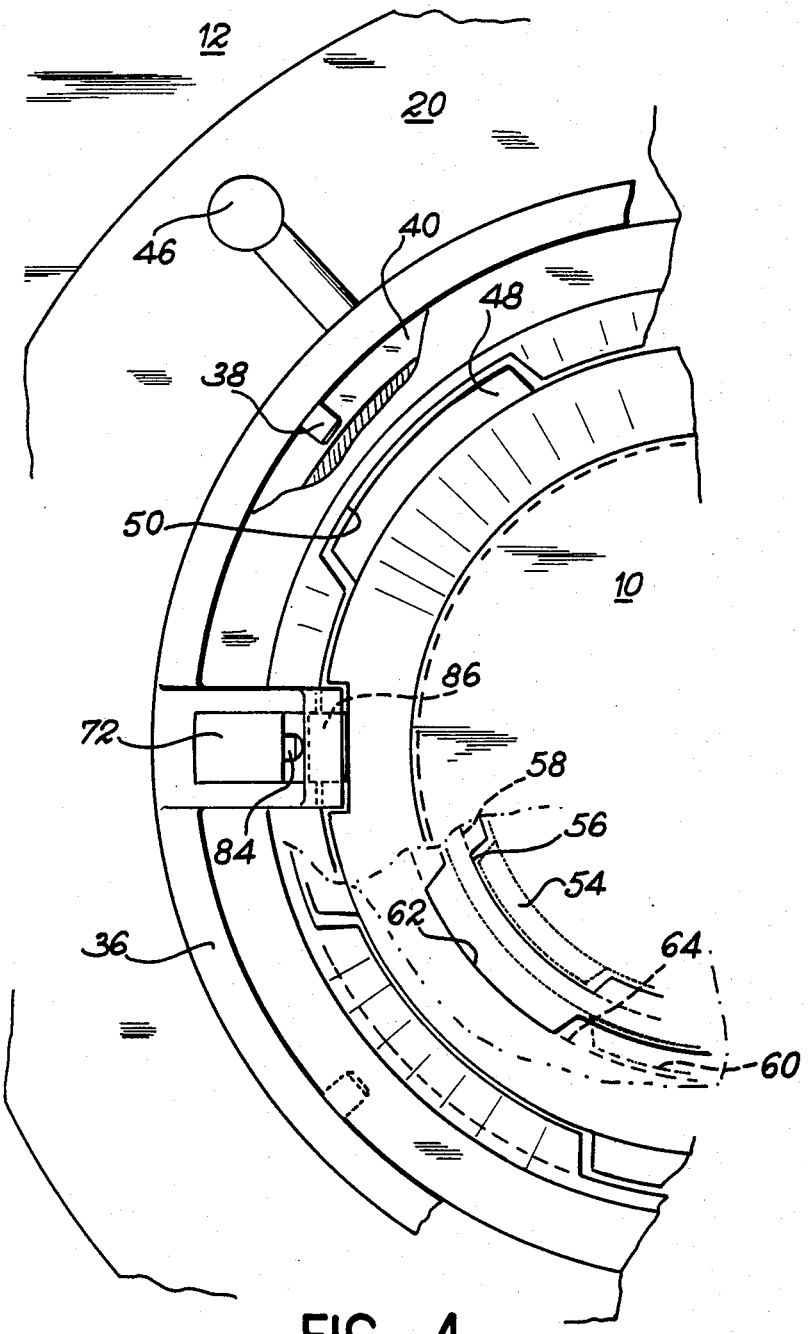
FIG. 4 a view comparable to FIG. 3 but on a larger scale showing the means for locking the container to the enclosure and the means for locking the container door on to the enclosure door.

FIG. 2, as well as FIGS. 3 and 4 show in greater detail the system 26 making it possible to lock container 10 on enclosure 12, as well as cover 18 to cover 24, whilst unlocking cover 18 from container 10. This system 26 comprises a locking ring 36 carried by flange 20 and mounted in rotary manner on the latter by means of at least one pin 38, which projects radially inwards into an annular groove 14 made on the outer periphery of flange 20. Locking ring 36 also has clips 42, which project radially inwards beyond the end of flange 20. As is illustrated more particularly in FIGS. 2 and 3, the ends of clips 42 engage in appropriate axial slots 44 formed on the outer periphery of flange 14 of container 10. Moreover, locking ring 36 is provided on its outer periphery with at least one operating handle 46 making it possible to simultaneously rotate ring 36 and container 10, when the latter is engaged in flange 20 of enclosure 12.

As is more particularly shown in FIGS. 2 to 4 flange 14 is locked to flange 20 by means of a bayonet system constituted by clips 48 of flange 40, which enter by notches 50 into an annular groove 52 formed in flange 20. In the same way cover 18 is locked to cover 24 by means of a bayonet fitting constituted by clips 54 of door 24, which penetrate by notches 56 formed in door 18 into circular arc-shaped recesses 58 terminated by abutments 66. The closing of container 10 by door 18 also takes place by means of a bayonet system formed by clips 60 on door 18 and which penetrate by notches 62 into an annular groove 64 formed in flange 14.

Obviously the relative dispositions of these different bayonet fittings are such that when door 18 is locked to the corresponding container 10 and when the latter faces flange 20 of enclosure 12, clips 42, 48 and 54 simultaneously face notches 34, 50 and 56.

In this position the rotation of locking ring 36 by means of operating handle 46 leads in a first phase to the simultaneous locking of flange 14 on to flange 20 and of door 18 on to door 24. Thus, container 10 and its door 18 are rotated by ring 36 due to the cooperation between clips 42 of the latter with the slots 44 formed on the container.

At the end of this first rotation phase of ring 36, clips 54 of door 24 bear against abutments 66 formed in slots 58 in such a way that door 18 is immobilized in rotation by door 24, the latter being itself immobilized in rotation by device 32. In the second rotation phase of locking ring 36 only container 10 rotates with the latter in such a way that the clips 60 formed on door 18 face notches 62 formed on flange 14 when ring 36 reaches the end of its travel, the end of travel position of ring 38 being accurately defined in the manner to be shown hereinafter.

Figure 5:
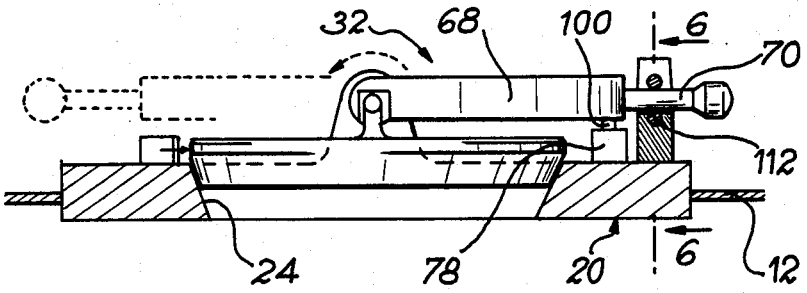
FIG. 5 a side view showing the flange and door of the enclosure, the rocking lever making it possible to operate the latter, as well as the locking mechanism immobilizing the lever in the enclosure door locking position.

A detailed description will now be given of the system 32 making it possible to lock and unlock door 24 of enclosure 12 of the double door 12 formed by doors 18 and 24 with reference to FIGS. 3 and 5. System 32 comprises a semicircular operating lever 68 located within enclosure 12 and whose two ends are mounted on flange 20 on either side of door 24 so as to pivot about two coinciding axes passing through the axis of opening 22. Each end of lever 68 is provided with an open notch, which is off-centred with respect to its pivoting axis, which receives a pivot pin carried by door 24. As a result of this feature door 24 tightly engages against the opening 22 of flange 20 and cannot be removed when lever 68 occupies the end position shown by the unbroken line in FIG. 5. Conversely door 24 is moved away from opening 22 and may optionally be removed from the interior of enclosure 12 by means of handle 34 when operating lever 68 pivots by 180° about its axis in order to occupy the position shown by broken lines in FIG. 5. For the constructional details of lever 68 and its cooperation with door 24, reference should be made to French Specification No. 71 17358, filed on May 13th 1971 by Societe LA CALHENE now French Pat. No. 2,137,106. In order to facilitate its manipulation, the median portion of lever 68 is provided with a handle 70. The manipulation of lever 68 by its handle 70, like that of door 24 or double door 18 and 24 by handle 34 takes place, for example, by means of a manipulating glove sealingly fixed to enclosure 12.

In the locking system described hereinbefore various incorrect or false manipulations or operations can be carried out, which are remedied by means of the safety system according to the invention. These incorrect manipulations are as follows:

- when there is no container 10 it is possible to pivot operating lever 68 about its axis for opening the door 24 of cell 12, which leads to a break in the seal of the latter,
- container 10 can be disconnected by rotating the locking ring 38 when the double door 18 and 24 is removed,
- double door 18 and 24 can be opened by means of operating lever 68 with container 10 not entirely locked to flange 20.

In order to prevent these various incorrect manipulations, the invention provides a safety device comprising a microswitch 72 sensitive to the presence of container 10 on flange 20 of the enclosure, a microswitch 74 sensitive to the locking ring 36 coming into the position corresponding to the locking of container 10 on enclosure 12, a microswitch 76 sensitive to the presence of door 24 in flange 20 of enclosure 12, a microswitch 78 sensitive to the presence of operating lever 68 in the position corresponding to the locking of door 24, a first locking mechanism 80 making it possible to immobilize the ring 36 in the inoperative position and in the locking position and a second locking mechanism 82 making it possible to immobilize lever 68 in the locking position of door 24.

As illustrated in FIG. 2, microswitch 72 is carried by the locking ring 36 and has a push-rod 84, whose axis is perpendicular to the axis of opening 22 formed in flange 20 and a pivoting lever 86 which bears on push-rod 84 and has an inclined surface 88, whose contact with container 10 controls the rocking of lever 86 and the displacement of push-rod 84 in the direction corresponding to the closing of microcontact 72. Microcontact 74 is carried by flange 20 on the outside of enclosure 12 and is provided with a push-rod 90 arranged tangentially with respect to ring 36 in such a way that when clip 92 carried by ring 36 comes into contact with push-rod 90, it controls the closing of microswitch 70. Microswitch 76 is carried by flange 20 within enclosure 12. Like microswitch 72, microswitch 76 is provided with a push-rod 94 arranged perpendicular to the axis of opening 22 and which cooperates with a pivoting lever 96 having an inclined surface 98, whose contact with the outer periphery of door 24 controls the closing of microswitch 76 by means of push rod 94. Microswitch 78 is also carried by flange 20 within enclosure 12 and comprises a push rod 100, whose axis is parallel to the axis of opening 22 and on which bears lever 68 when the latter is in the position corresponding to the locking of door 24.

As is more particularly shown in FIG. 3, locking mechanism 80 is an electromagnetic latch or bolt carried by flange 20 of the enclosure and having a rod 102 moving in accordance with a radial axis with respect to the opening 22 of the flange. The end of rod 102 is able to enter a hole 104 formed in locking ring 36 when the latter is in the inoperative position and is able to enter a hole 106 formed in locking ring 36 when the latter is in its locking position.

In the represented embodiment it can be seen that the travel of ring 36 between its inoperative position and its locking position is 60°. When locking mechanism 80 is not excited, a spring 100 normally urges rod 102 into hole 104 or hole 106.

Figure 6:
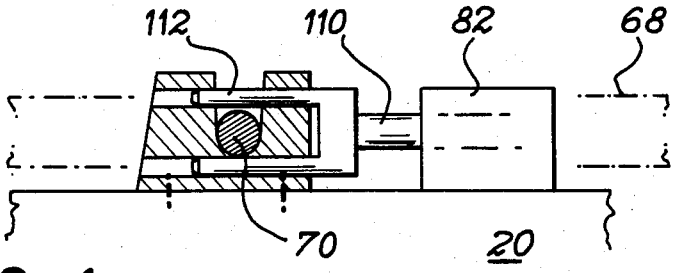
FIG. 6 a sectional view along the line VI—VI of FIG. 6 particularly showing the locking mechanism making it possible to immobilize th operating lever of the enclosure door in its locking position.
Figure 7:
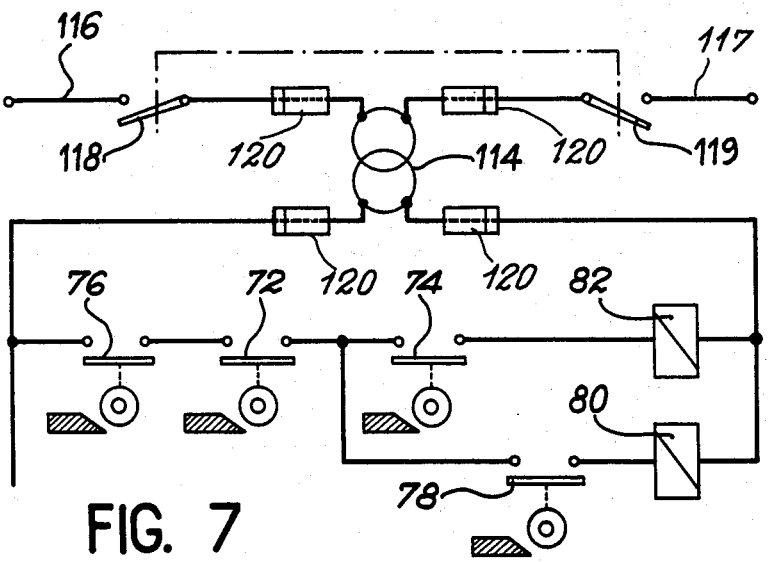

As is more particularly illustrated in FIG. 6, locking mechanism 82 is also an electromagnetic bolt or latch carried by flange 20 and comprising a moving rod 110, whose end is terminated by a fork-shaped member 112. Rod 110 moves in a tangential direction with respect to opening 22 formed in the flange, in such a way that fork 112 can overlap handle 70 of lever 68 when the latter is in the locking position of door 24 and as illustrated in FIGS. 5 and 6. The excitation of locking mechanism 82 controls the backward movement of rod 110 and fork 112 so as to free handle 70 and permit the pivoting of lever 68.

As has been shown, locking mechanisms 80 and 82 are normally in the locking position when they are not excited. It can be seen in FIG. 7 that the coil of locking mechanism 40 in connected in series with switches 72, 76 and 78, whilst the coil of locking mechanism 82 is connected in series with microswitches 72, 74 and 76. The power supply can take place across a transformer 114, whose primary is positioned between phase 116 and neutral 117 of a supply circuit, simultaneously controlled by two switches 118, 119, Circuit 116 can be connected to any appropriate power supply, particularly at a voltage of 220 V, whilst the voltage at the terminals of the secondary of transformer 114 can, for example, be 24 V. Finally, fuses 120 can be provided upstream and downstream of the transformer. The excitation of locking mechanism 80 is controlled by the simultaneous closing of microswitches 72, 76 and 78 and the opening of any one of these controls the closing of locking mechanism 80. In a comparable manner, the opening of locking mechanism 82 is controlled by the simultaneous closing of microswitches 72, 74 and 76.

The operation of the locking system and safety device described hereinbefore with reference to the attached drawings is as follows:

When there is no container 10, locking mechanism 72 which is sensitive to the presence of a container and locking mechanism 74 which is sensitive to the locking ring 36 arriving in its locking position are both open. In accordance with what has been stated hereinbefore the two locking mechanisms 80 and 82 are closed. In practice, this means that rod 102 of locking mechanism 80 enters hole 104 of ring 36 in order to prevent any rotation of the latter and fork 112 of locking mechanism 82 is in the position shown in FIG. 6 and consequently immobilizes the operating lever 68 of door 24 in the position corresponding to the locking of the latter. Thus, any unforeseen opening of door 24 by the pivoting of lever 68 is prevented by the locking of locking mechanism 82. Moreover, the latter cannot be unlocked by rotating ring 36 so that clip 92 is brought into contact with push-rod 90 of microswitch 74 in view of the fact that said ring is itself immobilized by locking mechanism 80. Finally, the intentional manual unlocking of locking mechanism 82 would make it necessary to press on both the push-rods 84 and 90 of microswitches 72 and 74 and to simultaneously pivot lever 68 about its axis, which is virtually impossible for one person to perform. This more particularly applies in view of the fact that switches 72 and 74 are preferably arranged in diametrically opposite positions with respect to door 24.

As soon as the clips 48 of a container 10 are introduced into notches 50 of flange 20, clips 54 of door 24 simultaneously enter notches 56 of door 18 and push-rod 84 moves under the action of lever 86 to close microswitch 72. As microswitches 76 and 78 are also then closed, the introduction of container 10 leads to the unlocking of locking mechanism 80. Thus, the end of rod 102 is disengaged from hole 104 in such a way that it is possible to rotate locking ring 36 by means of handle 46 in the direction of the arrow in FIG. 3. As has been stated hereinbefore, initially this rotation leads to the locking of container 10 on enclosure 12 and door 18 on door 24 and secondly of unlocking the door 18 of container 10.

At the end of this second part of the travel of ring 36, representing in all a 60° rotation, clip 92 engages push-rod 90 of microswitch 74 in order to close the latter. At this time rod 102 of locking mechanism 80 faces the hole 106 formed in ring 36. The closing of microswitch 74, which is added to that of microswitch 72, has the effect of opening locking mechanism 80, i.e. of releasing handle 70 of lever 68 by moving rod 110 and its forked end to the right with respect to FIG. 6. At this time the two locking mechanisms 80 and 82 are simultaneously open. It is therefore possible either to operate in reverse, i.e. unlock the container 10 for removing the same, or connect container 10 to enclosure 12 by removing the double door formed by doors 18 and 24.

In the first case the unlocking of container 10, which is brought about by rotating the locking ring 36 in the direction opposite to that of the arrow in FIG. 3, leads to clip 92 of push-rod 90 being moved away from microswitch 74, which leads to the opening of the latter and to a further locking of locking mechanism 82, thereby preventing any manipulations of lever 68.

In the second case the double door is unlocked by pivoting lever 68 by 180° about its axis, so that the double door performs a translation movement towards the inside of enclosure 12 over a distance corresponding to the displacement between the pivoting axis of lever 68 and the axis of the open notches in which are received the pivot pins carried by door 24, whilst bringing the opening of said notches towards the inside of enclosure 12 in order to permit the removal of the double door by means of handle 34. As from the start of pivoting of lever 68, push-rod 100 of microswitch 78 is no longer in contact with the lever in such a way that said microswitch opens. This brings about an immediate closure of locking mechanism 80, i.e. the end of rod 102 enters hole 106 of ring 36 and locks the latter in the position with container 10 locked on enclosure 12. Thus, any disassembly of container 10 following the unlocking of the double door is rendered impossible. Moreover, it is impossible for one person wishing to render the safety device according to the invention inoperative to operate pushbutton 100 of microswitch 78 within the enclosure, whilst rotating the ring 36 which is positioned externally of the latter for the purpose of disconnecting the container.

As stated hereinbefore the removal of the double door takes place, for example, by means of a manipulating glove which is tightly associated with enclosure 12, the removal taking place by means of handle 34 of door 24. This leads to the opening of microswitch 76 which, added to that of microswitch 78, makes it even more difficult to carry out an act of malevolence consisting of removing container 10 at this time. It would then be necessary to simultaneously operate microswitches 76 and 78, which are preferably positioned in diametrically opposite positions with respect to door 24, as well as to manipulate locking ring 36 positioned outside enclosure 12.

As has been shown by the preceding description, the safety device according to the invention makes it possible to prevent the opening of the enclosure door without there being any container present, the disconnection of a container without the double door being locked and the opening of the double door without the locking of the container being complete.

Moreover, it should be noted that this safety device is particularly uncomplicated and can be easily installed on existing locking systems. Furthermore, due to the electrical control of the locking mechanisms, any interruption in the power supply resulting, for example, from a power failure leads to the locking of the locking mechanisms, thereby preventing any inforeseen manipulation of the locking system. Finally, the safety device is entirely installed on the enclosure and more specifically on the flange thereof, which makes it possible to use all types of container without the latter having to undergo any modification.

What is claimed is:

1. In a locking system (26) between a first and a second enclosure, each of said enclosures comprising a flange (14, 20) defining an opening normally sealed by a door (18), said system comprising a locking ring (36) mounted on an outer periphery of the flange (26) of said first enclosure and rotatable between an inoperative position when said second enclosure is absent and a bolting position locking the second enclosure on the first enclosure, and an operating lever mounted on the flange of said first enclosure and movable between a locking position and an unlocking position of the door of said first enclosure, a safety device comprising a first locking mechanism (80) carried by the flange (20) of said first enclosure and normally locking the locking ring in said inoperative position and in said bolting position, a second locking mechanism (82) carried by the flange (20) of the first enclosure and normally locking the operating lever in said locking position, first detection means (72) carried by the locking ring (36) and sensitive to the presence of the second enclosure (10) for unlocking said first locking mechanism, second detection means (74) carried by the flange (20) of the first enclosure on the outside of said first enclosure (72) and sensitive to the presence of the locking ring in said bolting position for unlocking said second locking mechanism, third detection means (76) carried by the flange (20) of the first enclosure (12) within said first enclosure and sensitive to the presence of the operating lever in said locking position and fourth detection means (78) carried by the flange (20) of the first enclosure (12) within said first enclosure and sensitive to the presence of the door of the first enclosure for unlocking said first locking mechanism.

2. A safety device according to claim 1 wherein the first and second locking mechanisms are electrically controlled.

3. A safety device according to claim 2 the locking mechanisms are normally closed when electrically deenergized.

4. A safety device according to claim 2 wherein the first and second locking mechanisms are electrically controlled and normally closed when electrically deenergized.

* * * * *